US006074198A

United States Patent [19]

Rogelet

[11] Patent Number: 6,074,198

[45] Date of Patent: Jun. 13, 2000

[54] GAS LIGHTER

[75] Inventor: Thierry Rogelet, Lyons, France

[73] Assignee: Cricket S.A., Rillieux-la-Pape, France

[21] Appl. No.: 08/897,083

[22] Filed: Jul. 18, 1997

[30] Foreign Application Priority Data

Jul. 30, 1996 [FR] France ..... 96.09836
Dec. 12, 1996 [FR] France ..... 96.15528

[51] Int. Cl.[7] ..... F23D 11/36

[52] U.S. Cl. ..... 431/153; 431/277

[58] Field of Search ..... 431/277, 267, 431/273, 274, 153, 138

[56] References Cited

U.S. PATENT DOCUMENTS

| | | | |
|---|---|---|---|
| 1,872,244 | 8/1932 | Clark et al. | 431/138 |
| 3,465,355 | 9/1969 | Van Poppel | 431/138 |
| 3,910,751 | 10/1975 | Chernock | 431/273 |
| 3,910,752 | 10/1975 | Holl | 431/273 |
| 3,963,412 | 6/1976 | Chernock | 431/273 |
| 4,822,276 | 4/1989 | Bisbee | 431/153 |
| 5,002,482 | 3/1991 | Fairbanks et al. | 431/277 |
| 5,096,414 | 3/1992 | Zellweger | 431/277 |
| 5,104,313 | 4/1992 | Zellweger | 431/277 |
| 5,125,829 | 6/1992 | McDonough et al. | 431/255 |
| 5,490,773 | 2/1996 | Lloveras Capilla | 431/153 |
| 5,547,370 | 8/1996 | Hwang | 431/276 |
| 5,597,299 | 1/1997 | Jon | 431/153 |
| 5,655,902 | 8/1997 | Doucet | 431/153 |
| 5,759,023 | 6/1998 | Jenlis | 431/153 |

FOREIGN PATENT DOCUMENTS

| | | | |
|---|---|---|---|
| 08014559A | 1/1996 | Japan | 431/153 |
| WO 93/17282 | 9/1993 | WIPO . | |
| WO 95/04247 | 2/1995 | WIPO . | |

*Primary Examiner*—Carl D. Price
*Attorney, Agent, or Firm*—Oliff & Berridge, PLC.

[57] ABSTRACT

This lighter I of the type comprising a reservoir for containing liquefied petroleum gas, a valve (3) mounted on the reservoir and permitting the gas to leave the same, a valve opening mechanism (4, 5), as well as an ignition system comprising a flint (6) co-operating with a spark wheel (7) rotationally operated by at least one circular thumb wheel (10) mounted co-axially with the spark wheel. This lighter is characterized in that each thumb wheel (10) is independent of the spark wheel (7) and can pivot around its axis independently of the spark wheel, and in that rotational frictional engaging means are provided between the spark wheel and the at least one thumb wheel (10) when a force is exercised on the thumb wheel with a radial component having a value greater than a predetermined value.

28 Claims, 6 Drawing Sheets

GAS LIGHTER

BACKGROUND OF THE INVENTION

1. Field of the Invention

The present invention relates to a gas lighter comprising a safety ignition system, also referred to as "resistant to children", that is to say can not be ignited by a child of less than five years old.

2. Description of the Prior Art

A gas lighter generally comprises a reservoir for containing liquefied petroleum gases, a valve mounted on the reservoir permitting gas to leave the reservoir, an opening and closing system for the release of gas operated by a lever, a system of regulation of the release of gas as well as the ignition system. In a known way, the ignition system comprises a pyrophoric flint co-operating with a spark wheel and is frequently protected by a cap on the top of the lighter. The spark wheel is mounted on an axis between two thumb wheels which are attached to it. The spark wheel has a cylindrical shape and each of the thumb wheels comprises a disk having a diameter slightly greater than that of the spark wheel. The rims of the thumb wheels comprise unevenesses or teeth which make them rough. Thus, a user can easily operate the spark wheel with a finger or thumb, because the finger or thumb does not slide on the thumb wheels.

When the spark wheel, being in contact with the flint, is rotated by operation of the thumb wheels by a digit of the user, a spray of sparks is created and is followed by the action of the same digit against the gas opening lever which releases a quantity of gas. The spray of sparks ignites the gas, producing a flame which forms above the cap. This spray of sparks must be of a certain quantity and density to ignite the gas. If the spark wheel is moved too slowly or intermittently then sufficient sparks will not be produced to ignite the gas to create the flame.

Such a system requires a positive action on the part of the user to produce and maintain a flame and requires two independent movements one after the other—rotation of the spark wheel and action on the gas opening lever—to produce a flame.

However, it is desirable to increase the difficulty of operating such lighters so that children younger than five years old are not able to produce a flame with such lighters.

Lighters already exist providing a supplementary difficulty which must be overcome to produce a flame and several patents or patent applications describe such lighters. For example, patents U.S. Pat. No. 5,125,829, U.S. Pat. No. 5,002,482 or international patent applications WO 93/17282, WO 95/04247.

The lighters described in these publications comprise, compared to conventional lighters, a supplementary device making access to the thumb wheels of the spark wheel more difficult, or by blocking movement of the gas opening lever.

In this way, these lighters comprise a complex structure involving an increased cost of manufacture. Furthermore, the use of some of these lighters is complicated and requires a particular method of use. Even adults can find several difficulties in the operation of such lighters and need preliminary instructions. It is also possible for the safety device to be disabled so that the lighter operates as an ordinary non-child resistant lighter.

U.S. Pat. No. 5,096,414 concerns a lighter which does not contain thumb wheels fixed to the spark wheel, but two flat discs having a diameter greater than that of the spark wheel, and freely mounted to rotate about an axis corresponding to that of the spark wheel. In this case operation of the spark wheel is achieved directly by the flesh of the digit of the user, after deformation between the two free discs. However this lighter is difficult to light even for an adult because the flesh of the digit does not provide enough grip on the spark wheel to move it against the flint to generate a sufficient spray of sparks. The flesh of the finger is very variable from one user to another and although some users may be able to operate it effectively many other users are not.

U.S. Pat. No. 5,104,313 relates to a lighter in which the spark wheel is mechanically coupled to the thumb wheel when the user presses sideways on the thumb wheel against the action of a spring arranged between the thumb wheel and the spark wheel. The disadvantage with this lighter is that the mechanical coupling is only disengaged as long as the spring force is able to keep it disengaged. The small size of the spring and the small size of the elastomeric toric joint and its proximity to the heat of the flame will make it very difficult to ensure that the spring will retain the lighter in a child resistant state for the duration of the life of the lighter. It is likely that the spring parts will fail thus enabling the corresponding engaging parts of the mechanical coupling of the spark wheel and thumb wheel to engage thus making the lighter easy to ignite by a child. Furthermore a side force is required on the lighter. This is a departure from the normal operation of the lighter for an adult which will require preliminary instructions when the lighter is first used.

SUMMARY OF THE INVENTION

An objective of the invention is therefore to provide a lighter in which the ignition of the gas does not rely on the flesh of the digit of the user to control and overcome the frictional resistance of the flint against the spark wheel.

A further objective of the present invention is to provide a lighter which is easily operated by an adult, but very difficult to use by a child especially a child of less than five years old, and which is inexpensive to manufacture.

Another objective of the invention is to provide a reliable security system which can not be disabled and is constant in operation, without preliminary action by the user to release a separate blocking means.

Another objective of the invention is to have the functioning of the lighter as close as possible to the functioning of a traditional lighter, in which the unblocking action is realised at the same time as the ignition action, in such a way that the user has no need either for preliminary instructions or practice in order to operate the lighter.

To this end, the lighter concerned is of the type comprising a reservoir for containing a liquefied petroleum gas, a valve mounted on the reservoir and permitting gas to leave the reservoir, a mechanism for opening the valve, as well as an ignition system comprising a flint co-operating with a spark wheel rotationally operable by at least one circular thumb wheel mounted co-axially with the spark wheel, and characterised in that each thumb wheel is independent of the spark wheel and can pivot about its own axis independently of the spark wheel, and in that rotational frictional engaging means are provided between the spark wheel and/or its axle and the at least one thumb wheel which enables the thumb wheel to engage the spark wheel or its axle when a force is exercised on the thumb wheel having a radial component with a value greater than a predetermined value.

The spark wheel can be formed according to any known way: such as a stamped spark wheel or a coil spark wheel. This spark wheel can rotate about an axis with its ends located in the "ears" of the body of the lighter in the known way.

Two thumb wheels can be arranged symmetrically one on each side of the spark wheel. Each thumb wheel is in the form of a wheel with teeth grooved on its outside and a hole at its center in such way to enable it to turn freely about an axis which corresponds to the axis of the spark wheel.

According to a first aspect of the invention, the frictional engaging means are arranged on the side of the surface of the thumb wheel oriented toward the spark wheel and opposite the periphery of the spark wheel or a solid flange thereof.

If a rotational force is exercised on the thumb wheels, without a sufficiently high radial force, the frictional engaging means of the thumb wheels do not frictionally grip the spark wheel, and thus merely slide with respect to it, permitting a rotation of the thumb wheels independently of the spark wheel which remains fixed. The spark wheel may move only slowly or by a small amount or intermittently or a combination of these which are nevertheless insufficient to create a sufficiently dense spray of sparks to ignite the gas to create the flame. On the contrary if a sufficiently high radial force is exercised on the thumb wheels, the spark wheel becomes momentarily rotationally fixed to the thumb wheels by means of the frictional engaging means, which permits the rotational operation of the spark wheel and thus ignition, if this rotational movement is immediately followed by pivoting of the operating lever of the gas release valve.

The frictional force which permits the rotation of the spark wheel with the thumb wheels must be greater than the frictional force which exists between the flint and the spark wheel.

The frictional engaging means between the spark wheel and at least one thumb wheel can, according to a first possibility, comprise at least one tongue extending axially from the thumb wheel on the side of the spark wheel extending, beyond the periphery of the spark wheel or an integral flange thereof. Several tongues may be arranged in the form of a circle slightly greater in diameter to the diameter of the spark wheel or an integral flange thereof.

The form and arrangement of the tongues permits the ignition system to be made more or less difficult to operate.

The frictional engaging means between the spark wheel and at least one thumb wheel can also, according to a second possibility, comprise an integral rim on the face of the thumb wheel facing the side of the spark wheel, this rim, having an internal diameter slightly greater than the diameter of the spark wheel or an integral flange thereof, and overlapping at least partially this spark wheel or its flange.

The functioning of the ignition system is exactly the same as that in the preceding case.

According to a second aspect of the invention, the frictional engaging means between the spark wheel and the at least one thumb wheel are disposed on the side face of the thumb wheel oriented towards the "ears" of the body of the lighter, and opposite the periphery of an integral flange of the rotational axis of the spark wheel.

According to a first possibility, the frictional engaging means can comprise at least one tongue extending axially from the thumb wheel from the side opposed to the spark wheel, beyond the periphery of the integral flange, the different tongues being disposed in the form of a circle having a diameter slightly greater than the diameter of the flange.

The frictional engaging means can also comprise, according to a second possibility, a rim integral with the face of the thumb wheel oriented towards the "ear" of the body of the lighter, this rim having an internal diameter slightly greater than the diameter of the flange, and partially overlapping this flange.

Following a third embodiment of the invention, the frictional engaging means between the spark wheel and the at least one thumb wheel are arranged on the rotational axis of the spark wheel and on the internal annular face of the thumb wheel formed by the hole permitting the engagement of the thumb wheel on this axis.

According to a simple characteristic of the invention, at least one thumb wheel is provided which is adapted to be rotatably coupled to the spark wheel and mounted with a clearance on its axis of rotation.

According to a fourth embodiment of the invention, the frictional engaging means comprise a seat in which the thumb wheel is engaged, and in which the thumb wheel can be displaced radially, the walls of the thumb wheel and/or those defining the seat being formed in such a way that displacement of the thumb wheel is possible between an external radial position of the upper part of the thumb wheel with respect to the upper part of the spark wheel, in which the friction between the thumb wheel and the spark wheel is insufficient for the rotational operation of the thumb wheel to result in the rotational operation of the spark wheel, and an internal radial position of the upper part of the thumb wheel with respect to the upper part of the spark wheel, in which the friction is sufficient for the rotational operation of the thumb wheel to result in the rotational operation of the spark wheel. The upper parts of the thumb wheel and spark wheel respectively in this context being that part of the periphery which happens to be at any one time at the top most part of the lighter and accessible to operation by the user.

Thus, so long as insufficient radial pressure is exercised on the thumb wheel, notably by an infant of less than five years of age, the thumb wheel slides on the spark wheel. When, on the other hand, a sufficient radial pressure is exercised, for example by an adult, a rotational connection is created between the thumb wheel and the spark wheel, which makes ignition of the lighter possible.

The wall of the thumb wheel which engages in the seat can have a thickness which is increased in the direction of the external radial side of the thumb wheel. The seat can also itself comprise, in transverse cross section, a width which is increased in the direction of the same side as the thumb wheel, in a way which corresponds to the increase in the thickness of the thumb wheel, in such a way as to obtain a perfect intimate wedging engagement of the contacting surfaces. Preferably, the seat comprises a "V" shape in transverse cross section, and the all of the thumb wheel entering into engagement in the seat comprises corresponding surfaces with the same angles.

The thumb wheel may, alternatively, or additionally, comprise a peripheral circular wall extending on the side of the spark wheel or an integral flange rotating therewith, this peripheral circular wall of the thumb wheel comprising an internal diameter such that its radial internal face is located at a distance from the peripheral wall of the spark wheel or of the flange, in the said external radial position of the thumb wheel, but so that it acts in contact against this peripheral wall of the spark wheel or of the flange in the internal radial position of the thumb wheel.

This contact permits the generation of either all of the friction required to permit the rotational operation of the spark wheel, or only a part of this friction, the other part being generated at the level of the seat, in the manner described above.

The thumb wheel can equally comprise such a circular peripheral wall extending on the side opposite to the spark wheel, the internal radial face of which comes into contact, in the said internal radial position of the thumb wheel, against an integral flange on the rotational axis of the spark wheel.

The at least one wall of the thumb wheel engaged in the seat and/or at least one wall defining the seat, as well as, if needs be, the internal radial face of the said peripheral circular wall of the thumb wheel and/or of the corresponding flange arranged on the axle comprise frictionally engaging surfaces. These frictionally engaging surfaces will provide the desired friction force of engagement to achieve the desired effect for the ignition system as a whole namely to make ignition too difficult for children but achievable for adults.

The frictionally engaging surfaces may be provided by the choice of the material used for the engaging parts for example for the thumb wheel and spark wheel and/or its axle using combinations of materials such as: stainless steel, zinc/aluminium alloy known as Mazak, beryllium/aluminium alloy known as Beric, aluminium or brass. Preferably, the spark wheel and/or its axle and thumb wheel are made of different materials. For the spark wheel part which is a stamped type spark wheel the frictionally engaging surfaces of the spark wheel itself is comprised of the material of the spark wheel, preferably a suitably hardened steel.

All frictionally engaging surfaces may be provided by surface treatment for example using nickel, zinc, chromium or PTFE. Alternatively the frictional engaging surfaces may also be provided by mechanical treatment such as by a roughening of the surface to provide grip by friction. At least one of these surfaces may also comprise a covering of material having a high coefficient of friction such as an elastomer. Additionally combinations of these different types of frictionally engaging surface can be used in the same lighter.

Thus the frictionally engaging surfaces provide the required friction between these walls during the course of or at the end of the displacement of the thumb wheel.

The seat described above can be provided in the spark wheel, or in the axle fixed to the spark wheel, permitting the rotation of this spark wheel. The thumb wheel may comprise at the level of its central part defining its hole, radial slots which define wall portions having a degree of flexibility, these wall portions being deformed at the time of the force of engagement of the thumb wheel on the spark wheel or the axle and clicking in to the seat when the thumb wheel is positioned opposite the seat.

The seat can equally be defined unitedly with the spark wheel and by a collar or a flange arranged on the axle rotationally integral with the axle, the assembly being formed by the location of the thumb wheel against the spark wheel then assembly of the spark wheel and the axle.

The spark wheel-axle-thumb wheel assembly is thus particularly easy and quick to assemble.

Preferably in this case, the spark wheel comprises two lateral thumb wheels and the axle of this spark wheel is formed by two elements which are able to be fixed to the spark wheel or to each other enclosing the thumb wheels between them and the spark wheel.

According to a further aspect of the invention a ring is located in the seat between the engaging surfaces of the thumb wheel and spark wheel. This provides an additional means of controlling the frictional engagement of the two surfaces. The ring may be made from rubber or a suitable rubberised plastic. The ring may be rectangular or round in cross section. The ring may be deformed so that it extends up the sides of the seat between the side walls of the seat and the lateral sides of the lower portion of the thumb wheel.

The invention will now be described in more detail in the form of the following non limiting exemplary embodiments of the lighter which it concerns together with the following drawings.

DETAILED DESCRIPTION

Figure 1:
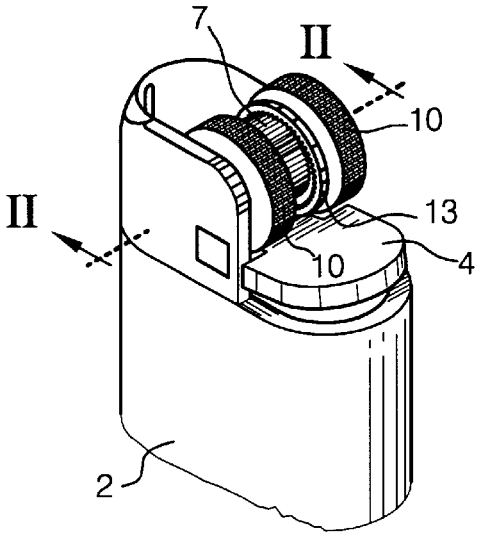
FIG. 1 is a perspective view of a lighter.

For simplicity's sake, the elements described in reference to one or more figures for one embodiment of the invention, which can be found in other embodiments shown in other figures will be designated by the same reference numerals.

Figure 3:
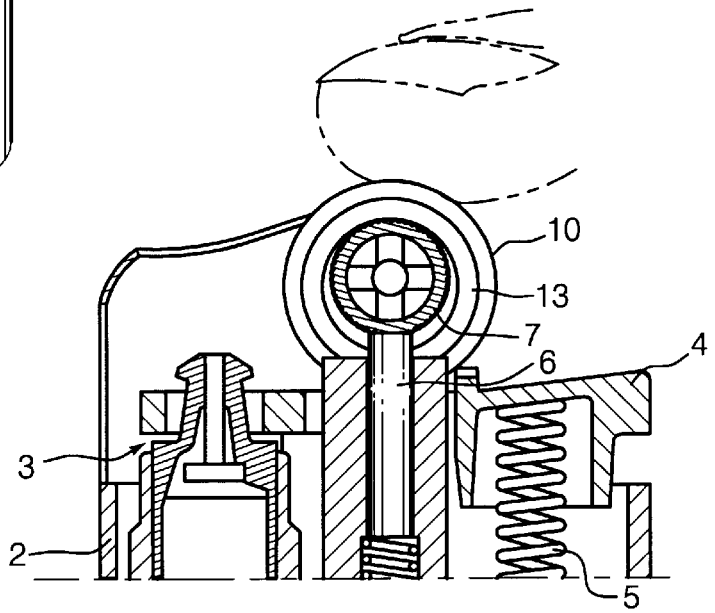
FIG. 3 is a transverse cross sectional view along the line III—III of FIG. 2, FIGS. 4 to 7 are similar views to FIG. 2, respectively representing four other embodiments of the lighter.
Figure 2:
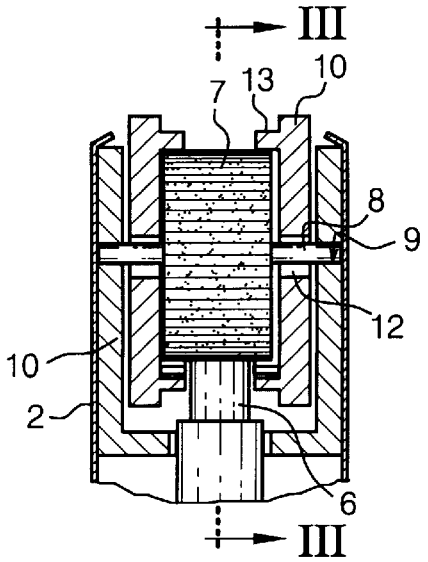
FIG. 2 is a transverse cross sectional view in enlarged scale of the upper part of this lighter, along the line II—II of FIG. 1.

The lighter shown in FIGS. 1 to 3 comprises a body forming a reservoir for containing a liquefied petroleum gas. The upper part of the reservoir is provided with a valve 3 normally maintained closed, and actionable towards its open position by a lever 4. This lever 4 is normally maintained in the closed position of the valve by the action of a spring 5. The ignition system of the lighter comprises a flint 6 susceptible to providing sparks under the action of rubbing exercised by a spark wheel 7, the latter being arranged to be rotatably operated by means of two thumb wheels 10.

On each side of the spark wheel 7 two thumb wheels 10 are arranged comprised of two circular discs with a central hole 12 for their assembly on the axle 8. This assembly is arranged with a clearance in order to permit the radial movement of each thumb wheel with respect to the axle 8. Each thumb wheel is independent of the spark wheel 7 and comprises a ring 13 on its side facing the spark wheel 7. This ring comprises an internal diameter slightly greater than the diameter of the spark wheel 7 and partially overlaps the spark wheel 7. It comprises an internal engaging surface having a desired coefficient of friction, provided either by it being made from a material having the desired coefficient of friction, or by a coating thereon or by the provision of a surface finish provided by mechanical means.

The clearance between the axle 8 and the thumb wheels 10 is greater than the clearance permitted between the ring 13 and the corresponding surface of the spark wheel 7.

If a rotational force is exercised on the thumb wheels 10, without a significant radial force, the engaging surface of the ring 13 slides along the indentations of the spark wheel 7, which permits the rotating of the thumb wheel independently of the spark wheel which for its part remains fixed or does not move sufficiently or quickly enough to generate the required density of sparks. On the contrary, if the rotational movement of the thumb wheels is accompanied by a sufficiently high radial force, the ring 13 comes firmly into contact with the surface of the spark wheel or of the surface of a lateral flange which it comprises. This force thus produces a rotational coupling of the thumb wheels and the spark wheel, thus resulting in the rotational operation of the spark wheel and then by its frictional action against the flint, ultimately produces the required spray of sparks.

FIGS. 4 to 7 show variations of this lighter.

Figure 4:
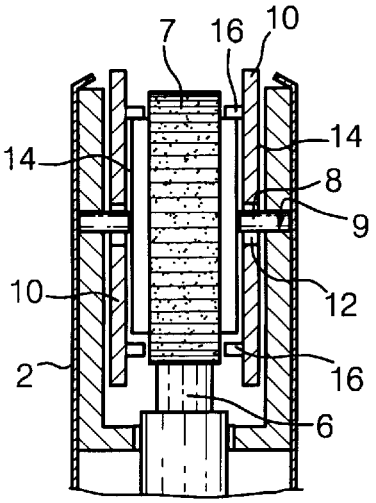

In the embodiment shown in FIG. 4, the spark wheel is fixed to two circular flanges 14 arranged one on each side of it, these two flanges each comprising an external thumb wheel engaging surface having the desired coefficient of friction. For their part, each thumb wheel 10 is provided, on its side facing the spark wheel, a certain number of tongues 16, regularly, angularly separated, and extending parallel to the rotating axle 8. These tongues 16 are arranged beyond the periphery of the flanges 14, following a circle having a diameter which is slightly greater than the diameter of the flanges. The tongues have internal frictionally engaging surfaces with the desired coefficient of friction with the corresponding surfaces of the flanges 14.

The clearance between the axle 8 and the thumb wheels 10 is greater than the clearance between the tongues and the lateral surfaces of the flanges 14.

In practise, the thumb wheels can be independently rotated on the spark wheel if the radial forces exerted on the thumb wheels is small. In effect, in such a case, the tongues 16 slide on the frictional engaging surface of the flanges 14, without operating them at least not to a sufficient extent. On the contrary if the rotational operation of the thumb wheels 10 is accompanied by a sufficient radial force, the tongues 16 thus engage the flanges 14 and consequently the spark wheel 7 which is rotated to a sufficient extent to generate a sufficient spray of sparks to ignite the gas.

Figure 5:
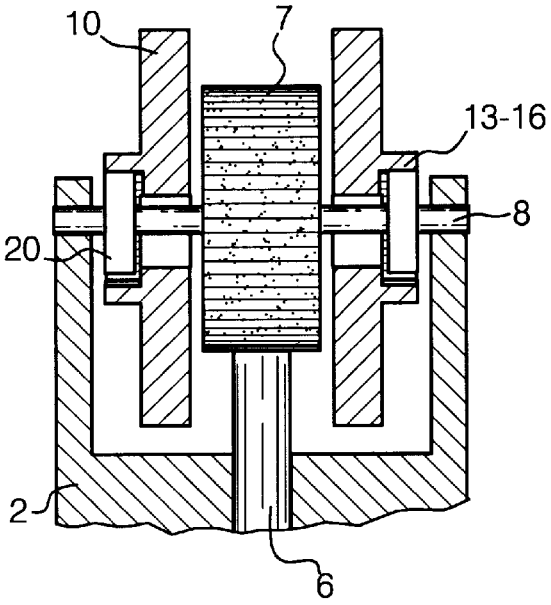

In the embodiment shown in FIG. 5, each thumb wheel 10 comprises, on its surface facing the "ear" of the body 2, the tongues 16 arranged in the form of a co-axial circle about the axle 8, whereas the axle 8 comprises an integral flange which is aligned with these tongues 16.

The internal faces of the different tongues 16 define a circle having a diameter slightly greater than the diameter of the flange 20, and these tongues extend axially from the thumb wheels 10 beyond the periphery of the flange 20.

In the example shown in the drawing, the tongues 16 are mechanically roughened on their internal faces, and the flange 20 is mechanically roughened on its peripheral face, in such a way as to enable frictional gripping with the tongues 16.

The tongues 16 can be replaced by a ring 13 such as described previously.

Figure 6:
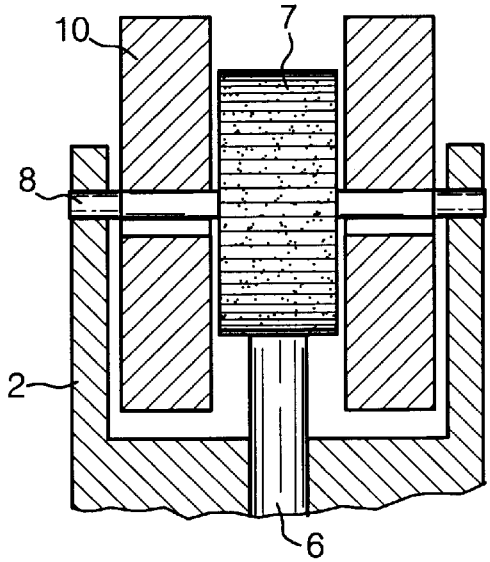

In the embodiment shown in FIG. 6, the axle is mechanically treated to provide a roughened surface under each thumb wheel 10, and the wall of the thumb wheels 10 defining the hole 12 may also be provided with a roughened surface. A radial pressure on the thumb wheels 10 results in the frictional gripping of the thumb wheels 10 and the axle 8.

Figure 7:
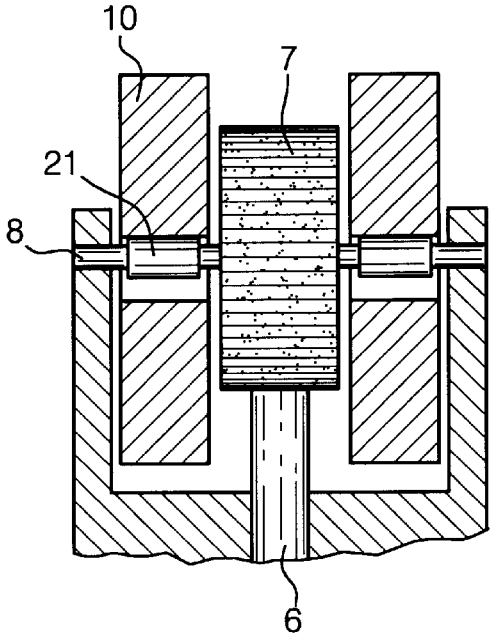

The embodiment shown in FIG. 7 is very similar to that shown in FIG. 6, except that the axle comprises surfaces which are not mechanically treated to provide a roughened surface, but comprise elastomeric sleeves 21 fixed on them. The walls of the thumb wheels 10 define holes 12 which are smooth, that is to say adapted by the choice of material or coating to frictionally grip the sleeves 21, and thus the axle 8.

Figure 8:
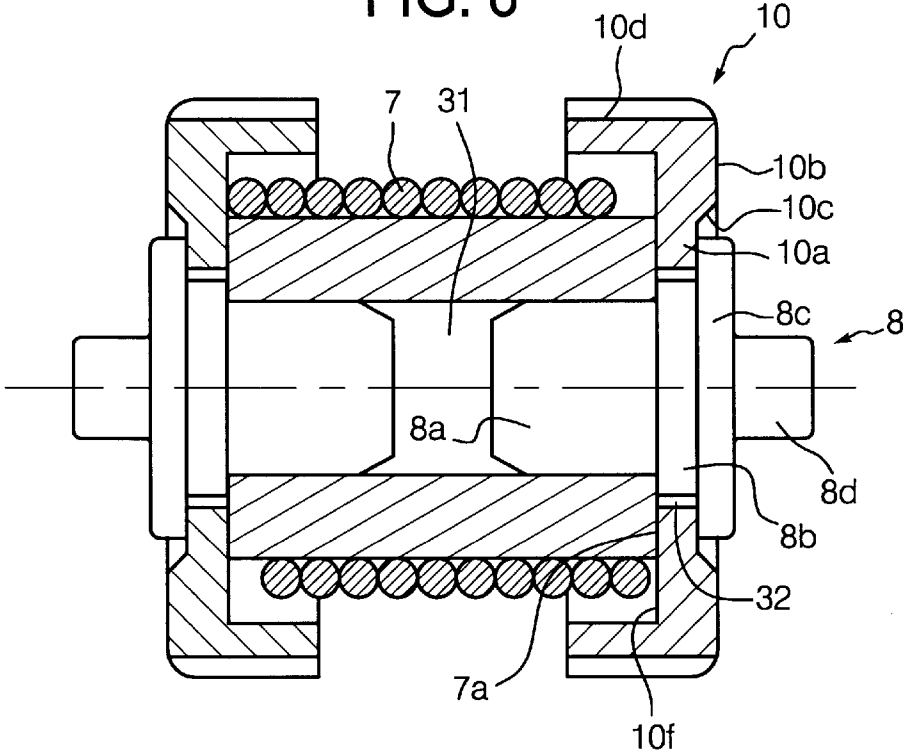
FIG. 8 is a transverse cross sectional view in enlarged scale of another embodiment of the spark wheel of the upper part of this lighter, showing elements forming axles which it comprises for its rotational assembly on the lighter and two thumb wheels.

In the embodiment shown in FIG. 8, the spark wheel is hollow internally and the axle permitting its pivotal mounting is formed by two elements 8.

Each of the elements 8 comprises several co-axial cylindrical parts, which are as follows:

- A part 8*a* comprising a diameter slightly greater than that of the cavity 31 of the spark wheel 7, thus providing an interference fit therein,
- An intermediate part 8*b*, having a diameter slightly greater than that of the cavity 31 of the spark wheel 7,
- A part 8*c* having a diameter greater than that of part 8*b* forming a flange, and
- A part 8*d* forming a spindle arranged to be engaged in a hole correspondingly provided in one of the two parallel ears which are provided in the upper part of the body of the lighter, to support the spark wheel 7 and the thumb wheels 10.

Each thumb wheel 10 comprises a central hole having a diameter greater than that of the said part 8*b*, but less than that of the said part 8*c*.

The internal radial zone 10*a* of the thumb wheel 10 comprises a thickness slightly less than the thickness of the part 8*b*, and connects with the external radial zone 10*b* of the thumb wheel 10 by a conical intermediate face 10*c*.

As shown in FIG. 8, the two thumb wheels 10 are arranged to be assembled to the spark wheel 7 by enclosing them between the elements 8 and the spark wheel 7. The elements 8 are fixed to the spark wheel by interference fit, or by other fixing means such as by adhesive, of the parts 8*a* of the elements 8 in the cavity 31 of the spark wheel 7, imprisoning the thumb wheels between the spark wheel 7 and the pre-defined parts 8*c* of the elements 8, and forming a gap of seat 32 between the external surface of part 8*b* and the internal surface of the thumb wheel zone 10*a*.

Thanks to the dimensions of the central hole of the thumb wheel 10, as described above, of the zone 10*a* and the parts 8*b* and 8*c*, the thumb wheels 10 can be radially displaced with respect to the spark wheel 7 and the elements 8, between an external radial position of the upper part of the thumb wheel 10 with respect to the upper part of the spark wheel 7, shown in FIG. 8, and a respective internal radial position, in which the thumb wheels 10 are bought under pressure by the thumb.

It is evident that the internal diameter of the zone 10*a* of each thumb wheel 10, is less than that of the external diameter of the part 8*c* extending beyond the part 8*b*. These diameters as well as the position of the conical face 10*c* on the thumb wheel 10 can be such that when a radial pressure is exercised on the thumb wheels 10, the conical face 10*c* meets the part 8*c* before the internal engaging surface of the thumb wheel part 10*a* comes into contact with the external engaging surface of the part 8*b*, resulting in a consequential axial force of the thumb wheel 10 against the side face of the spark wheel. Thus additional frictional engaging surfaces are provided between the thumb wheel and the spark wheel on the external end side 7*a* of the spark wheel and the corresponding inward lateral surface 10*f* on the thumb wheel. The materials of the corresponding parts forming these surfaces are chosen to provide the desired coefficient of friction to control the frictional engagement of the thumb wheel and spark wheel.

In the said external radial position, the friction between the thumb wheel 10 and the spark wheel 7 is insufficient for the rotational operation of the thumb wheel to result in the required rotational operation of the spark wheel. Thus, when an insufficient radial pressure is exercised on the thumb wheel, the thumb wheel slides at least partially on the spark wheel and element 8 without gripping it sufficiently and ignition of the lighter is impossible.

The material comprising the element 8, notably a plastic material, or Mazak, aluminium, steel, beric or brass, comprises a certain resilience, conferring a certain elastic deformability on the part 8*c*. This, combined with an adequate inclination of the wall 10*c*, of the order of 45°, permits the return of the thumb wheel 10 to the external radial position, by the elastic resilience of this material, when the pressure exercised on the thumb wheel ceases. The external radial surface of part 8*c* could also be made conical to co-operate with conical face 10*c* and provide an additional frictional engaging surface between them.

In addition, the thumb wheels circular walls 10*d* extend axially. These walls provide a contact surface essential for the thumb.

The wall 10*d* of each thumb wheel can comprise an internal radial engaging surface located at a distance from the external peripheral surface of the spark wheel 7 in the said external radial position of the thumb wheel 10, which comes into contact with this external peripheral surface of the spark wheel 7, or of an integral lateral flange of the same, in the said internal radial position of the thumb wheel. This contact permits the generation of all or part of the said friction permitting the rotational operation of the spark wheel. Again the materials of these surfaces will provide the desired coefficient of friction. And the total combined frictional effect of all the engaging surfaces will be designed to provide the required frictional grip on the spark wheel for a pre-determined radial force on the thumb wheel.

Figure 9:
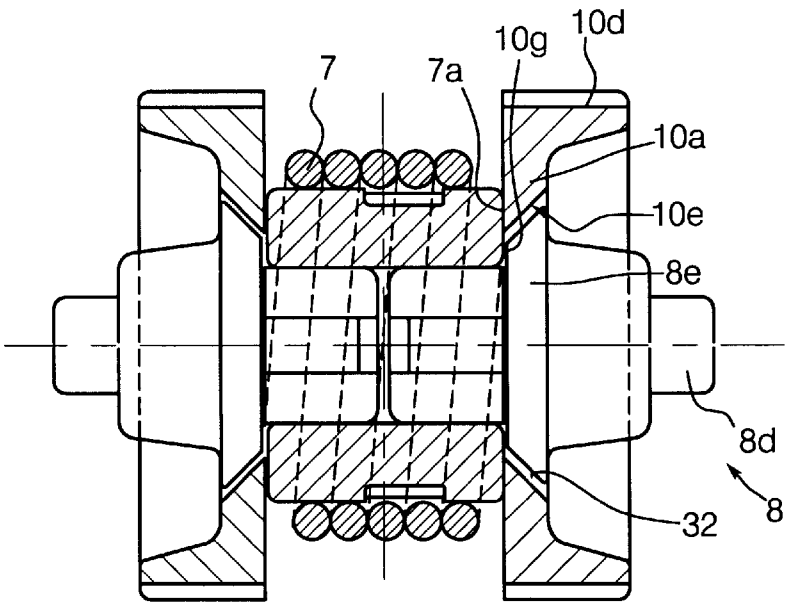
FIGS. 9 to 12 are similar views to FIG. 8, of different embodiments of the invention.

In the embodiment shown in FIG. 9, each element 8 comprises a part 8*e* forming a collar, whose surface facing the spark wheel 7 is conical and is inclined towards the outside of the spark wheel.

The seat 32 provided by this conical surface and by the lateral side face 7*a* of the spark wheel 7 comprises a section whose width decreases progressively towards the axis of rotation.

The part 10*a* of the thumb wheel 10 comprises a conical face 10*e* with a corresponding incline to that of the conical face of the collar 8*e*, in such a way that the thumb wheel progressively engages in the seat 32 during its displacement towards its internal radial position.

The contact surfaces of the thumb wheel 10, the lateral face 7*a* and the part 8*e* are comprised of materials, coatings or the surface finish to provide the desired coefficient of friction between them which will provide the desired extent of frictional grip, in this position, to establish a rotational engagement of the thumb wheel 10 and the spark wheel 7.

In addition, the circular walls 10*d* of the thumb wheels 10 are oriented in the opposite direction to that shown in FIG. 8, in order to mask the element 8.

An important feature of the embodiment shown in FIG. 9 is the acute angle formed by the face of the collar 8*e* and the lateral face 7*a* thus defining a wedge shaped space or seat 32. These surfaces engage with the corresponding surfaces 10*e* and 10*g* of the thumb wheel respectively.

It has been found that greater control of the frictional engagement between the two engaging surfaces can be achieved with this angled contact. The angle can be chosen to give the desired friction properties since the precise angle will determine the surface area of the frictionally engaging surface which has a significant effect on the force required to operate the lighter. The greater the contact area the greater the friction, and the force required on the thumb wheel to successfully operate the spark wheel is lower.

Figure 10:
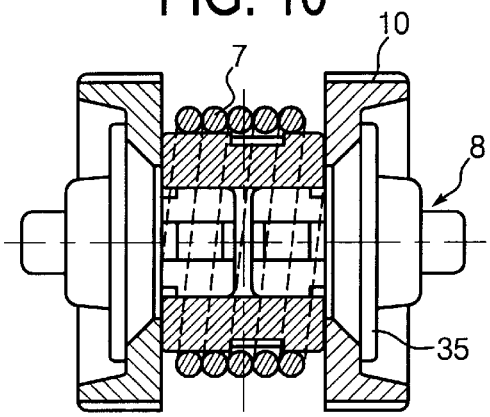

The embodiment shown in FIG. 10 is similar to that shown in FIG. 9, except that flanges 35 are provided to the elements 8. These will preferably be formed as an integral part of the element 8, such as a moulded component of this shape, made of Mazak, for example, or stamped in aluminium or turned out of steel. It may also be fixed by adhesive or other suitable means. By means of the flange 35 a further pair of frictional engaging surfaces may be created between the external face of the thumb wheel and the internal face of the flange 35.

This embodiment has the advantage, compared to the previous embodiment, that the angle can be varied without varying the potential lateral clearance of the thumb wheels.

Figure 11:
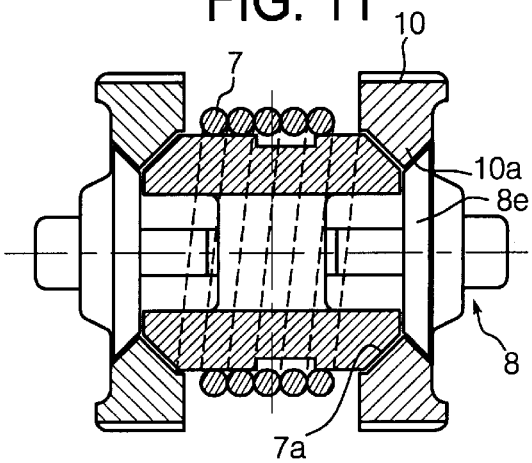

FIG. 11 shows an embodiment in which the lateral surface of the spark wheel is conical, the element 8 comprises a collar 8*e* and the thumb wheel 10 comprises a part 10*a* having two complimentary conical surfaces. Here the external side face 7*a* of the spark wheel 7 is inclined which allows a direct radial force to be applied to its surface. Equally, the contact surfaces are of materials specifically chosen for their frictional properties or preferably roughened.

Figure 12:
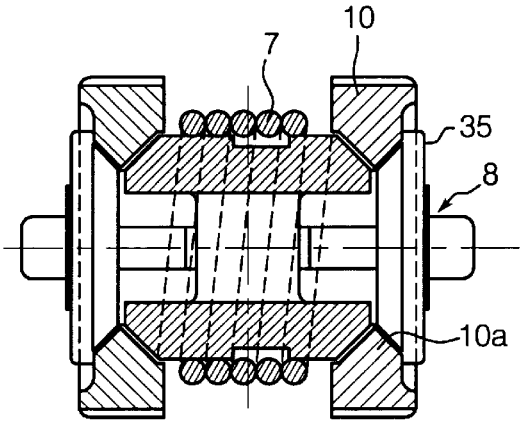

The embodiment shown in FIG. 12 is similar to that in FIG. 11, except that the flanges 35 are located as described in reference to FIG. 10.

Figure 13:
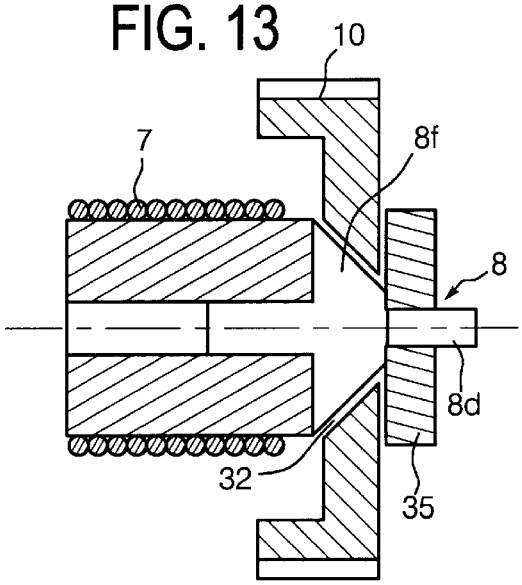
FIGS. 13 to 21 are simplified schematic views in longitudinal cross section, of one of the ends of the spark wheel, of an element forming an axle as above and of a thumb wheel, according to other embodiments of the invention.

In the embodiment shown in FIG. 13, the element 8 comprises a conical collar 8*f* and an elongate spindle 8*d*, receiving a flange 35, this collar 8*f* and this flange 35 defining the seat 32.

Figure 14:
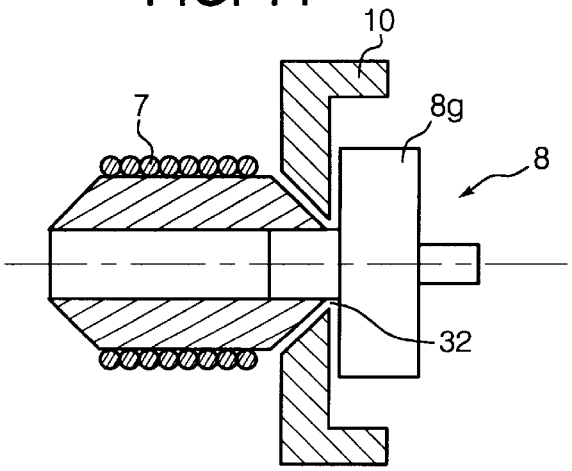

In the embodiment shown in FIG. 14, the lateral surface of the spark wheel is conical, and the element 8 comprises a collar 8*g* defining the seat 32 with its conical surface.

Figure 15:
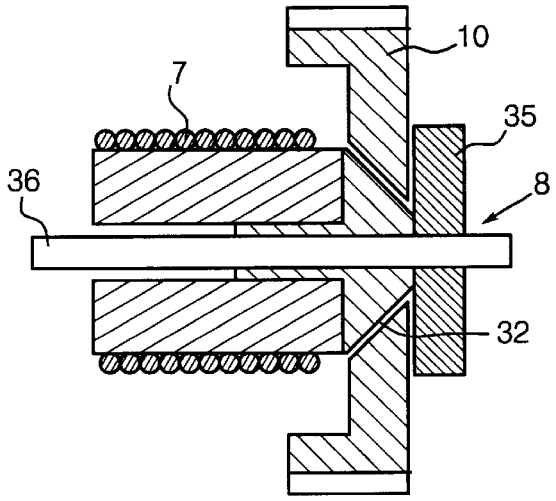

FIG. 15 shows an embodiment similar to that shown in FIG. 9, except that the two elements 8 do not comprise the pivoting axis of the spark wheel 7, but are simply arranged on a rod 36 which itself comprises the axle. The rod 36 is fixed to the element 8.

Figure 16:
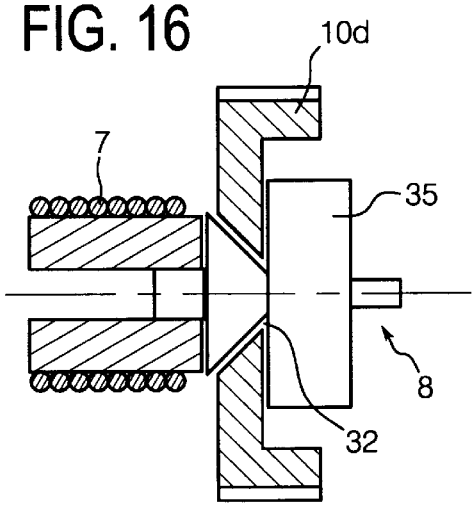

FIG. 16 shows an embodiment similar to that shown in FIG. 13, with the wall 10*d* extending on the opposite side of the spark wheel enabling it to mask the flange 35, and the element 8 comprising two parts which are fixed together by suitable means such as press fitting or by an adhesive.

In the different embodiments shown in FIGS. 13 to 16, the wall 10*d* can also permit the direct operation of the spark wheel 7 or the flange 35, as described previously in reference to FIG. 8.

Figure 17:
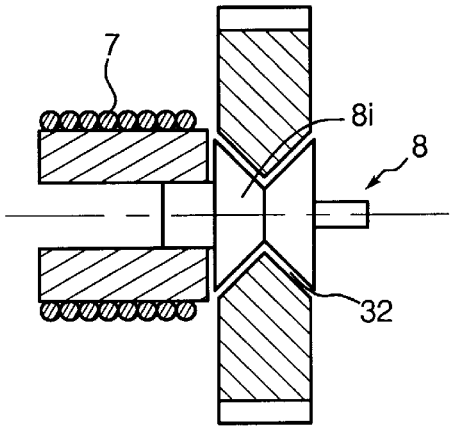

FIG. 17 shows an embodiment similar to that shown in FIG. 11, except that the lateral surface of the spark wheel 7 is not conical, and the element 8 comprises a collar 8*i* having two conical surfaces with opposing inclinations, such that they define the seat 32.

Figure 18:
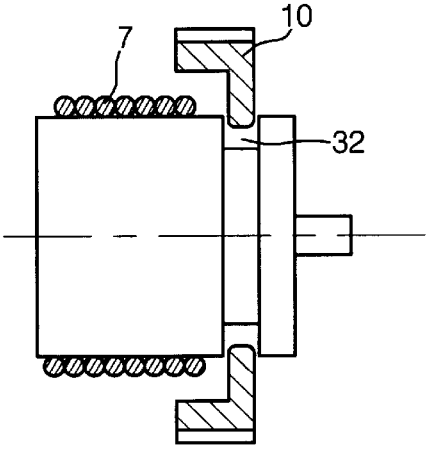
Figure 19:
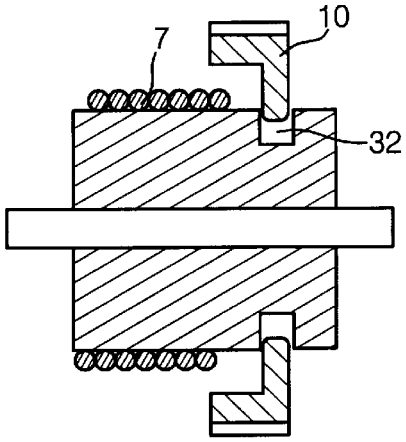

FIGS. 18 and 19 show a spark wheel 7 in which is provided an integral seat 32. The thumb wheel 10 is fitted into the seat 32 at the time of manufacture, using appropriate mechanical pressing means so that the thumb wheel clicks into place in the seat 32 and can not be removed during normal use of the lighter. The thumb wheel preferably comprises radial slots which provide the required flexibility for the mechanical pressing on to the spark wheel.

The respective friction engaging surfaces of the thumb wheel 10 and of the spark wheel 7 are provided by the base defining the seat 32 and by the corresponding internal diameter of the innermost part of the thumb wheels. These surfaces will comprise materials or coatings or surface finishes which will create the desired coefficient of friction to provide the desired frictional engagement properties.

Figure 21:
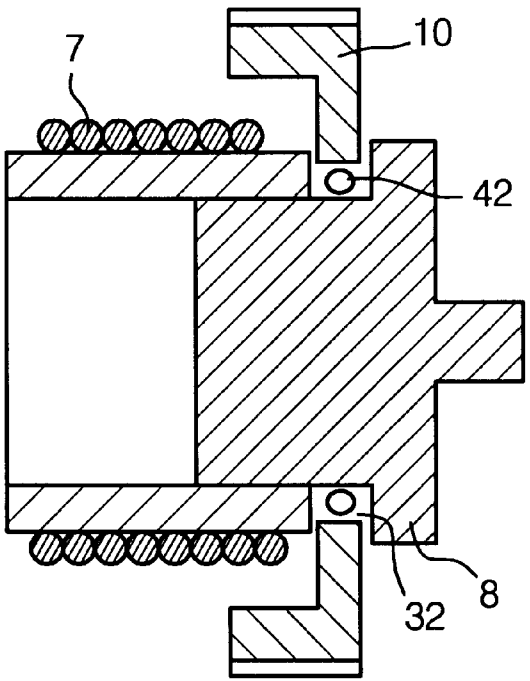
Figure 20:
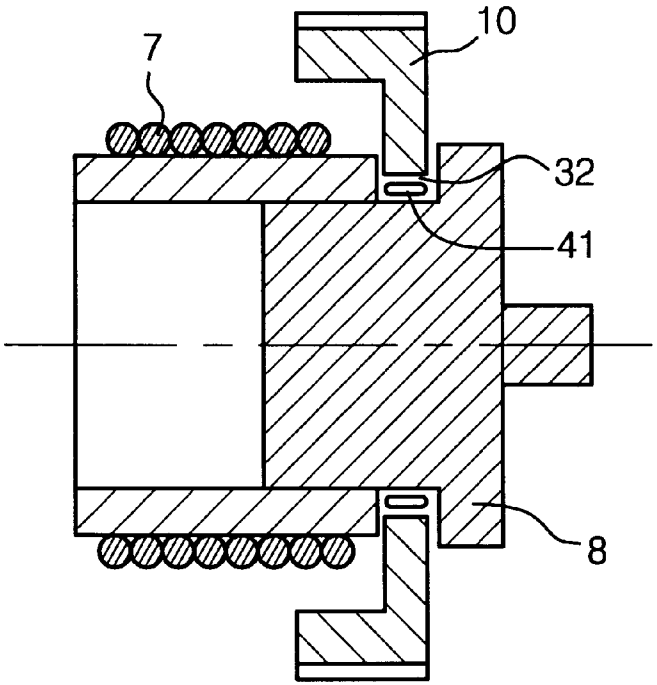

Referring now to FIGS. 20 and 21 a further embodiment is shown in which a ring 41 is located in the seat 32 between the engaging surfaces of the thumb wheel and spark wheel. This provides an additional means of controlling the frictional engagement of the two surfaces. The ring 41 may be made from rubber or a suitable rubberised plastic. The ring may be rectangular in cross section as shown in FIG. 20 or round in cross section as shown in FIG. 21 or any suitable shape. The ring may be deformed so that it extends up the sides of the seat 23 between the side walls of the seat 23 and the lateral sides of the lower portion of the thumb wheel 10.

Thus the rubber provides the frictional engaging surface between the thumb wheel and the spark wheel and enables the desired friction force required to be determined. The rubber deforms when additional radial force is applied thus increasing the surface area of contact between the thumb wheel and the spark wheel. This increases the area of the resilient frictional engaging surface with an increase in the radial force applied by the user and thus has the effect of producing the required frictional engagement produced with a smaller force applied by the user.

As it has been shown above, the invention provides a big improvement on the existing techniques by providing a lighter with a security ignition system having a simple construction, permitting the ignition of the lighter in a single, familiar movement, whilst preventing ignition by young children, by providing sufficient difficulty for them to achieve the rotational coupling between the spark wheel and the thumb wheels.

The invention also permits the provision of an ignition system which enables it to be pre-assembled before its assembly in the lighter.

It is also apparent from the above description, that several possibilities can be envisaged concerning the generation of the required friction engaging force between the spark wheel and/or its axle, and one or both the thumb wheels: it can be by friction acting only at the level of the axis, that is to say between the thumb wheel and the wall of the axis, or by friction acting laterally, that is to say between the thumb wheel and a face of the elements 8, of a flange 35 and/or of the spark wheel 7, or by friction operating only peripherally, between the wall 10*d* of the thumb wheel and the spark wheel or a flange carried on the axis, or by a combination of axial, lateral or peripheral friction.

Furthermore all of these contacting surfaces can be made of different materials to provide the desired coefficient of friction, selected from, for example, Mazak, Beric, Steel, aluminium or plastic. Equally the engaging surfaces may be coated or treated with nickel, zinc or chromium plating or PTFE surfacing and may also be mechanically surface treated by polishing or by abrading.

As clearly illustrated in the Figures described in detail above, the spark wheel assembly includes at least one surface that extends in a plane that is not parallel to the central axis. Such surface is shown both substantially perpendicular to the central axis and inclined relative to the central axis and can be present on any one or all of the components that form the spark wheel assembly, including for example spark wheel 7 and/or elements 8. Similarly, the variously disclosed thumb wheels 10 include at least one surface that is not parallel to the central axis. Such surface is shown both substantially perpendicular and inclined relative to the central axis. The surface may comprise several surfaces that are not parallel to the central axis that abut to form a V-shape.

It will be appreciated that the invention is not limited to the specific embodiments described above, but that it includes all the various possible embodiments.

The spark wheel 7 can be of the wire or coil type fixedly secured to a spark wheel carrier of hollow cross section as shown in the figures. Another type of spark wheel could be equally convenient to the wire type, for example a stamped spark wheel of hollow cross section.

What is claimed is:

1. A gas lighter comprising:

a body having a reservoir therein for containing a liquefied petroleum gas;

a valve mounted on the reservoir to permit gas to leave the reservoir;

a mechanism connected to the valve for opening the valve;

a flint supported by the body and located near the valve;

a spark wheel assembly rotatably supported by the body, the spark wheel assembly including an axle defining an axis of rotation and a spark wheel supported by the axle, and having a radial surface with respect to the axle; and at least one thumb wheel mounted co-axially with the spark wheel assembly for rotation independent of the spark wheel assembly, wherein a member extends axially from the thumb wheel and includes an annular radial surface extending radially with respect to the axle that engages the radial surface of the spark wheel assembly when a force is applied to the thumb wheel with a radial component having a value greater than a predetermined value required to rotationally fix the thumb wheel to the spark wheel assembly by friction so that the member acts on the spark wheel assembly and rotates the spark wheel to co-operate with the flint to create a spark.

2. The gas lighter of claim 1 wherein the spark wheel assembly includes an integral flange extending axially from the spark wheel and the thumb wheel member engages the integral flange of the spark wheel upon application of the force.

3. The gas lighter of claim 1 wherein the member has an engaging surface that contacts the spark wheel assembly made of a material, a coating, or a surface finish having predetermined coefficient of friction.

4. The gas lighter of claim 3 wherein the material, coating or surface treatment includes a material selected from the group consisting of nickel, zinc, chromium and PTFE.

5. The gas lighter of claim 3 wherein the material of the engaging surface is selected from the group consisting of stainless steel, zinc/aluminum alloy, beryllium/aluminum alloy, other aluminum alloy, aluminum and brass.

6. A gas lighter comprising:

a body having a reservoir therein for containing a liquefied petroleum gas;

a valve mounted on the reservoir to permit gas to leave the reservoir;

a mechanism connected to the valve for opening the valve;

a flint supported by the body and located near the valve;

a spark wheel assembly rotatably supported by the body, the spark wheel assembly including an axle defining an axis of rotation and a spark wheel supported by the axle;

at least one thumb wheel mounted co-axially with the spark wheel for rotation independent of the spark wheel; and an intermediate deformable friction member disposed between the at least one thumb wheel and the spark wheel assembly such that when a force is applied to the thumb wheel with a radial component having a value greater than a predetermined value required to rotationally fix the thumb wheel to the spark wheel assembly, the intermediate member transmits the force applied to the thumb wheel to the spark wheel assembly to cause the spark wheel to rotate and co-operate with the flint to create a spark.

7. The gas lighter of claim 6 wherein the intermediate friction member is an elastomeric member.

8. The gas lighter of claim 6 wherein the intermediate friction member is a ring.

9. A gas lighter including a reservoir for containing a liquefied petroleum gas, a valve mounted on the reservoir that permits gas to leave the reservoir, a mechanism that opens and closes the valve, and an ignition system, the ignition system comprising:

a flint;

a spark wheel assembly positioned to cooperate with the flint to create sparks and mounted to rotate about a central axis, the spark wheel assembly including a first surface that extends in a plane that is not parallel to the central axis; and at least one thumb wheel that selectively actuates rotation of the spark wheel assembly, wherein the at least one thumb wheel is mounted co-axially with the spark wheel assembly to rotate independently of the spark wheel assembly, the at least one thumb wheel including a second surface that is not parallel to the central axis, wherein the second surface of the thumb wheel frictionally acts on the first surface of the spark wheel assembly when a force is applied to the thumb wheel with a radial component that exceeds a predetermined value required to rotationally fix the thumb wheel to the spark wheel assembly by friction to thereby rotate the spark wheel assembly to create sparks with the flint.

10. The gas lighter of claim 9 wherein the first surface of the spark wheel assembly is partially conical and the second surface of the thumb wheel is partially conical.

11. The gas lighter of claim 9 wherein the second surface of the thumb wheel forms a V-shape.

12. The gas lighter of claim 9 wherein the second surface of the thumb wheel is substantially perpendicular to the central axis.

13. The gas lighter of claim 9 wherein the first surface of the spark wheel assembly is substantially perpendicular to the central axis.

14. The gas lighter of claim 9 wherein the spark wheel assembly includes a spark wheel and an axle, wherein the axle comprises two axle parts, each of the two parts being connected to the spark wheel and at least one of the two parts forming a seat for the thumb wheel.

15. The gas lighter of claim 14 wherein the first surface is on at least one of the axle parts.

16. The gas lighter of claim 14 wherein the first surface includes a surface on the spark wheel and the axle part that is substantially perpendicular to the central axis.

17. The gas lighter of claim 14 wherein the first surface includes a surface on one of the spark wheel and the axle part that is substantially perpendicular to the central axis and a surface on the other of the spark wheel and the axle part that is inclined relative to the central axis.

18. The gas lighter of claim 14 wherein the first surface includes a pair of opposed conical surfaces on the axle part.

19. The gas lighter of claim 14 wherein the first surface includes a surface that is substantially inclined relative to the central axis and a surface that is substantially perpendicular to the central axis on at least one of the axle parts.

20. The gas lighter of claim 14 wherein the first surface includes a surface on the spark wheel that is inclined relative to the central axis and surface on at least one of the axle parts that is inclined relative to the central axis.

21. The gas lighter of claim 14 wherein the thumb wheel is laterally retained by the axle parts.

22. The gas lighter of claim 9 wherein the at least one thumb wheel is axially fixed with respect to the spark wheel assembly.

23. A gas lighter including a reservoir for containing a liquefied petroleum gas, a valve mounted on the reservoir that permits gas to leave the reservoir, a mechanism that opens and closes the valve, and an ignition system, the ignition system comprising:

a flint;

a spark wheel assembly positioned to cooperate with the flint to create sparks and mounted to rotate about a central axis; and at least one thumb wheel that selectively actuates rotation of the spark wheel assembly, wherein an annular groove is formed on at least one of the at least one thumb wheel and spark wheel assembly, and wherein the at least one thumb wheel is mounted co-axially with the spark wheel assembly to rotate independently of the spark wheel assembly and the annular groove causes the at least one thumb wheel to be laterally retained with respect to the spark wheel assembly, the at least one thumb wheel including a surface that frictionally acts on the annular groove when a force is applied to the thumb wheel with a radial component that exceeds a predetermined value required to rotationally fix the thumb wheel to the spark wheel assembly by friction to thereby rotate the spark wheel assembly to create sparks with the flint.

24. The gas lighter of claim 23 wherein the annular groove is formed in the spark wheel assembly.

25. The gas lighter of claim 23 wherein the spark wheel assembly comprises a spark wheel and an axle, wherein the annular groove is a seat defined between the spark wheel and the axle.

26. The gas lighter of claim 23 wherein the spark wheel assembly comprises a spark wheel and an axle, wherein the annular groove is formed in the axle.

27. The gas lighter of claim 23 wherein the spark wheel assembly includes a spark wheel and the annular groove is formed in the spark wheel.

28. The gas lighter of claim 27 further comprising an intermediate friction member disposed in the annular groove.

* * * * *